US011284174B2

(12) United States Patent
Ohara et al.

(10) Patent No.: US 11,284,174 B2
(45) Date of Patent: Mar. 22, 2022

(54) LOUDSPEAKER DEVICE

(71) Applicant: SONY CORPORATION, Tokyo (JP)

(72) Inventors: Masaaki Ohara, Saitama (JP); Kazutaka Nakashima, Chiba (JP)

(73) Assignee: SONY CORPORATION, Tokyo (JP)

( * ) Notice: Subject to any disclaimer, the term of this patent is extended or adjusted under 35 U.S.C. 154(b) by 344 days.

(21) Appl. No.: 16/330,239

(22) PCT Filed: Sep. 1, 2017

(86) PCT No.: PCT/JP2017/031638
§ 371 (c)(1),
(2) Date: Mar. 4, 2019

(87) PCT Pub. No.: WO2018/083876
PCT Pub. Date: May 11, 2018

(65) Prior Publication Data

US 2021/0281937 A1 Sep. 9, 2021

(30) Foreign Application Priority Data

Nov. 1, 2016 (JP) ..... JP2016-214705

(51) Int. Cl.
*H04R 1/02* (2006.01)
*A42B 3/30* (2006.01)
(Continued)

(52) U.S. Cl.
CPC ..... *H04R 1/026* (2013.01); *A42B 3/30* (2013.01); *H04R 1/025* (2013.01); *H04R 3/00* (2013.01);
(Continued)

(58) Field of Classification Search
CPC ..... H04R 1/026; H04R 1/025; H04R 3/00; H04R 9/025; H04R 9/06; H04R 2420/07; A42B 3/30; A42B 3/166
(Continued)

(56) References Cited

U.S. PATENT DOCUMENTS 4,979,586 A * 12/1990 Lazzeroni ..... A42B 3/166 181/129

FOREIGN PATENT DOCUMENTS

JP 58-125478 U 8/1983
JP 3054182 U 9/1998
(Continued)

OTHER PUBLICATIONS

International Search Report and Written Opinion of PCT Application No. PCT/JP2017/031638, dated Nov. 21, 2017, 09 pages of ISRWO.

(Continued)

*Primary Examiner* — Md S Elahee
(74) *Attorney, Agent, or Firm* — Chip Law Group

(57) ABSTRACT

Provided is a loudspeaker device that includes a body and a lock lever. The body includes an actuator that operates in response to an input drive signal, and an attachment part attachable to an adapter mounted on a helmet and including an engagement part. The lock lever includes a locking part, the lock lever being rotatably supported by the body, and allow, when rotated, the locking part to be engaged with the engagement part. The loudspeaker device is designed to be attachable and detachable to and from the adapter. The body is designed to be locked on the adapter, as a result of engagement of the locking part with the engagement part. The loudspeaker device allows for easy mounting on the helmet, while being prevented in a mounted state from falling from the helmet.

5 Claims, 17 Drawing Sheets

(51) Int. Cl.
*H04R 3/00* (2006.01)
*H04R 9/02* (2006.01)
*H04R 9/06* (2006.01)

(52) U.S. Cl.
CPC ..... *H04R 9/025* (2013.01); *H04R 9/06* (2013.01); *H04R 2420/07* (2013.01)

(58) Field of Classification Search
USPC ..... 381/387
See application file for complete search history.

(56) References Cited

FOREIGN PATENT DOCUMENTS

| | | | |
|---|---|---|---|
| JP | 3054182 | U | 11/1998 |
| JP | 2003-263165 | A | 9/2003 |
| JP | 2004-023484 | A | 1/2004 |
| JP | 2007-051395 | A | 3/2007 |
| JP | 2008-301038 | A | 12/2008 |
| JP | 2012-070245 | A | 4/2012 |
| WO | 2009/069287 | A1 | 6/2009 |
| WO | 2016/094582 | A1 | 6/2016 |

OTHER PUBLICATIONS

Office Action for JP Patent Application No. 2018-548575, dated Jun. 8, 2021, 03 pages of Office Action and 04 pages of English Translation.
Office Action for JP Patent Application No. 2018-548575 dated Dec. 7, 2021, 02 pages of English Translation and 02 pages of Office Action.

* cited by examiner

LOUDSPEAKER DEVICE

CROSS REFERENCE TO RELATED APPLICATIONS

This application is a U.S. National Phase of International Patent Application No. PCT/JP2017/031638 filed on Sep. 1, 2017, which claims priority benefit of Japanese Patent Application No. JP 2016-214705 filed in the Japan Patent Office on Nov. 1, 2016. Each of the above-referenced applications is hereby incorporated herein by reference in its entirety.

TECHNICAL FIELD

The present technology relates to a technical field including a loudspeaker device which is used while being mounted via an adapter on a helmet.

BACKGROUND ART

A known type of loudspeaker device can output sound, using an actuator that operates (vibrates) upon input of drive signal. Some of this type of loudspeaker devices are used while being mounted on a helmet (see Non-Patent Literature 1, for example).

In such loudspeaker device used while being mounted on a helmet, for example, the drive signal wirelessly received from a mobile terminal such as mobile phone is input to the actuator, and the actuator is allowed to operate in response to the drive signal, thereby the sound is output. For example, the output sound is typically transmitted from the loudspeaker device to the helmet, and is then transmitted from the helmet to the user typically through bone conduction or the like.

With such loudspeaker device mounted and made available on the helmet, it now becomes possible to enjoy music or the like during sports like, for example, skiing or the like, making the sports or the like more pleasantly.

CITATION LIST

Non-Patent Literature

Non-Patent Literature 1: Headwave_Music for Motorcyclists.pdf, [searched on Nov. 1, 2016], through the Internet <URL: https://www.headwave.de/index.php>.

DISCLOSURE OF INVENTION

Technical Problem

Now the aforementioned loudspeaker device, used while being mounted on the helmet, is desired to be kept always in good condition in use, while being prevented from falling from the helmet.

In addition, although the loudspeaker device is not always necessarily used in some applications or the like of the helmet, the loudspeaker device, in the case where the loudspeaker device is used, is also preferably designed to be mounted easily on the helmet.

The loudspeaker device of the present technology is aimed at solving the aforementioned problem, preventing fall from the helmet in a mounted state, and making the mounting on the helmet easier.

Solution to Problem

First, a loudspeaker device according to the present technology includes: a body including an actuator that operates in response to an input drive signal, and an attachment part that is attachable to an adapter mounted on a helmet and including an engagement part; and a lock lever including a locking part, the lock lever being rotatably supported by the body, and designed so as to allow, when rotated, the locking part to be engaged with the engagement part. The loudspeaker device is designed to be attachable and detachable to and from the adapter. The body is locked on the adapter, as a result of engagement of the locking part with the engagement part.

With such design, the locking part is engaged with the engagement part mounted on the helmet, and this allows for mounting via the adapter on the helmet, and locking of the body on the adapter.

Second, the loudspeaker device described above preferably includes: a housing having the actuator arranged inside; and a base member including a locking ridge against which the locking part, while being elastically deformed, is slid as the lock lever is rotated, the base member being fixed to the housing. When the locking part is engaged with the engagement part, the locking part is preferably locked at an edge on the locking ridge, after elastically returned as the locking part crosses over a top of the locking ridge.

With such design, the hand used for locking the body on the adapter can sense a touch of so-called clicking, caused when the elastically returned locking part is locked at the edge on the locking ridge.

Third, in the loudspeaker device described above, directionality of mounting relative to the adapter is preferably variable.

With such design, the direction of the body relative to the adapter is made variable.

Advantageous Effects of Invention

According to the present technology, mounting via the adapter on the helmet is made available by engaging the locking part with the engagement part of the adapter mounted on the helmet, and the body is locked on the adapter, and this allows for easy mounting on the helmet, while being prevented in a mounted state from falling from the helmet.

Note that the effects described in this specification are merely illustrative but not restrictive, allowing any other effects.

MODE(S) FOR CARRYING OUT THE INVENTION

Figure 1:
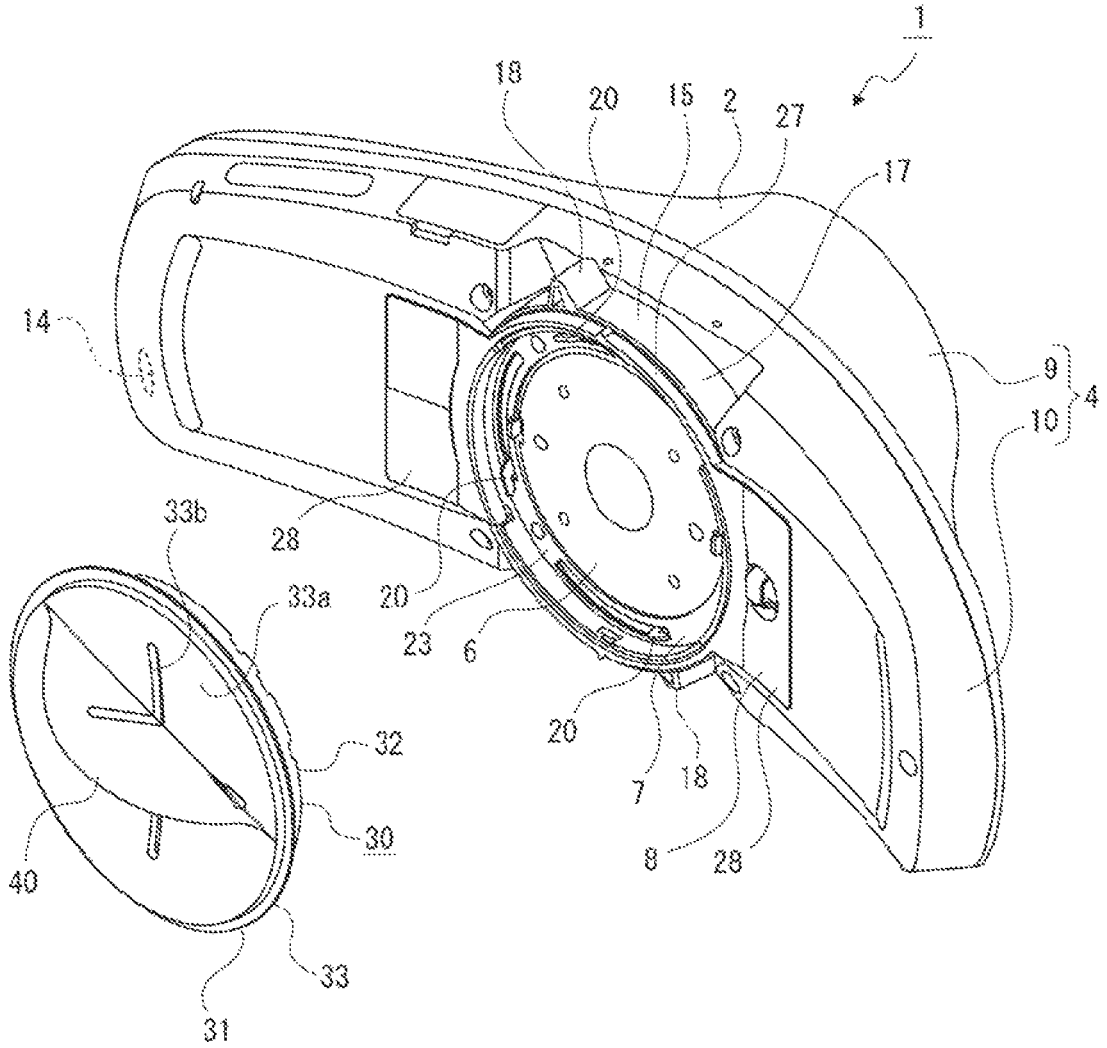
FIG. 1 illustrates, in conjunction with FIG. 2 to FIG. 17, an embodiment of the loudspeaker device of the present technology, and is a perspective view separately illustrating the loudspeaker device and the adapter.

Modes for carrying out the loudspeaker device of the present technology will be explained below, referring to the attached drawings.

The loudspeaker device illustrated below is used while being attached to the adapter, and the loudspeaker device is provided with an annular lock lever. The following explanation will be made assuming the axial direction of the lock lever as the vertical direction, and assuming the direction the loudspeaker device is attached to the adapter as the downward direction. In addition, the loudspeaker device is formed so as to extend in a certain direction, so that the explanation will be made assuming the longitudinal direction, which is the direction of extension, as the lateral direction.

Note, however, that the vertical, front-back, and lateral directions are merely illustrative for the convenience sake, avoiding the present technology from being applied restrictively in these directions.

<Structure of Loudspeaker Device>

A loudspeaker device 1 has a body 2 and a lock lever 3 (see FIG. 1 to FIG. 4).

The body 2 has a housing 4, an actuator 5, a mounting plate 6, a base member 7 and a dressing cover 8, in which the relevant individual parts are arranged or supported, inside or outside the housing 4.

The housing 4 has a cover 9 and a case 10 which are coupled vertically. The housing 4 has a gently curved form as a whole, so as to extend nearly laterally.

The case 10 has, at the lateral center, a placement recess 11 and an annular recess 12 which individually open downwards. The placement recess 11 is made deeper than the annular recess 12, and the annular recess 12 is formed around the placement recess 11. The bottom face (top face) that composes the annular recess 12 is formed as a catch surface 12*a*.

In the case 10, formed are mounting recesses 13, 13. The mounting recesses 13, 13 are formed on the outer circumference of the annular recess 12, laterally away from each other. The mounting recesses 13, 13 are made shallower than the annular recess 12.

In spaces inside the housing 4 and on both sides of the placement recess 11, arranged are unillustrated battery (rechargeable battery), circuit board and so forth.

The housing 4 has, formed at one lateral end, a connection jack 14. The connection jack 14 allows for connection of a connector 72 which is connected via a cord 71 with a certain rigidity to a microphone 70 (see FIG. 5).

Figure 3:
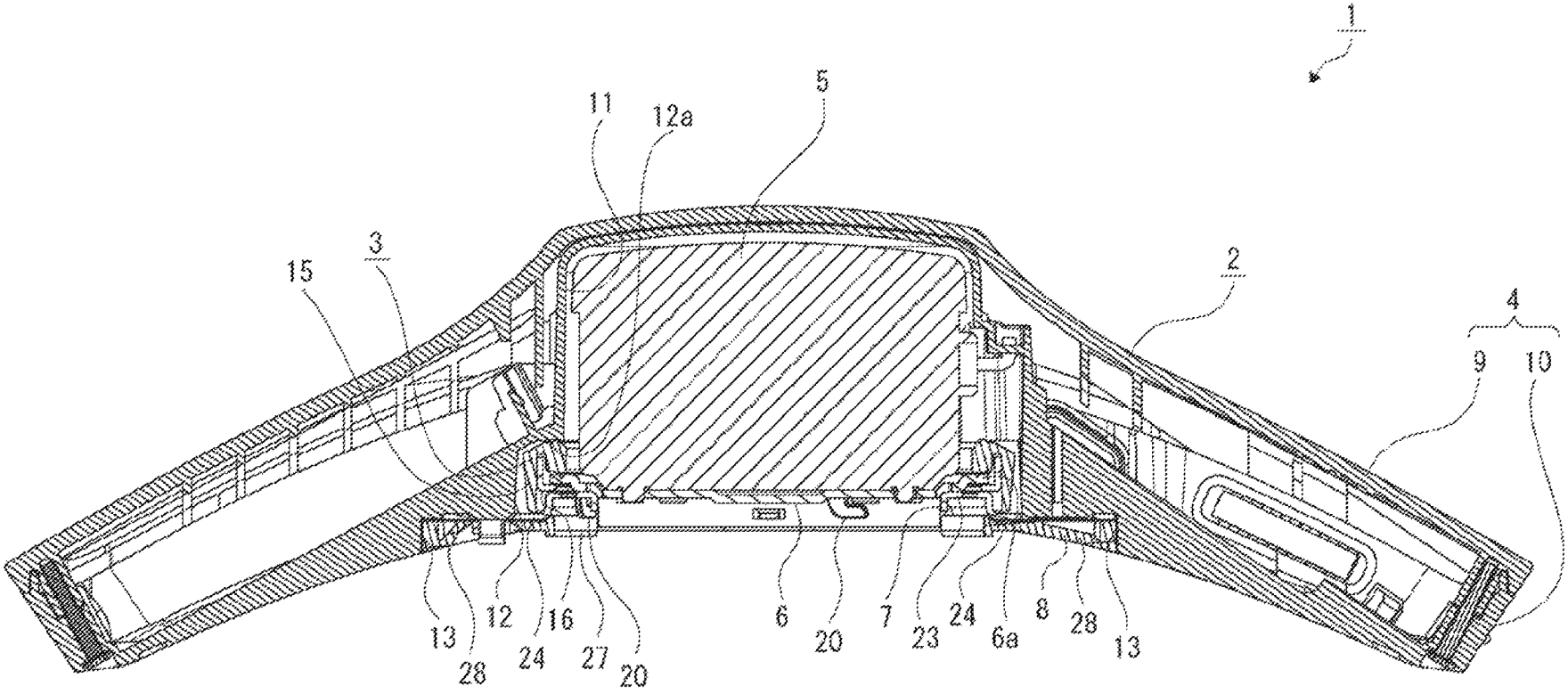
FIG. 3 is a cross-sectional view of the loudspeaker device.
Figure 4:
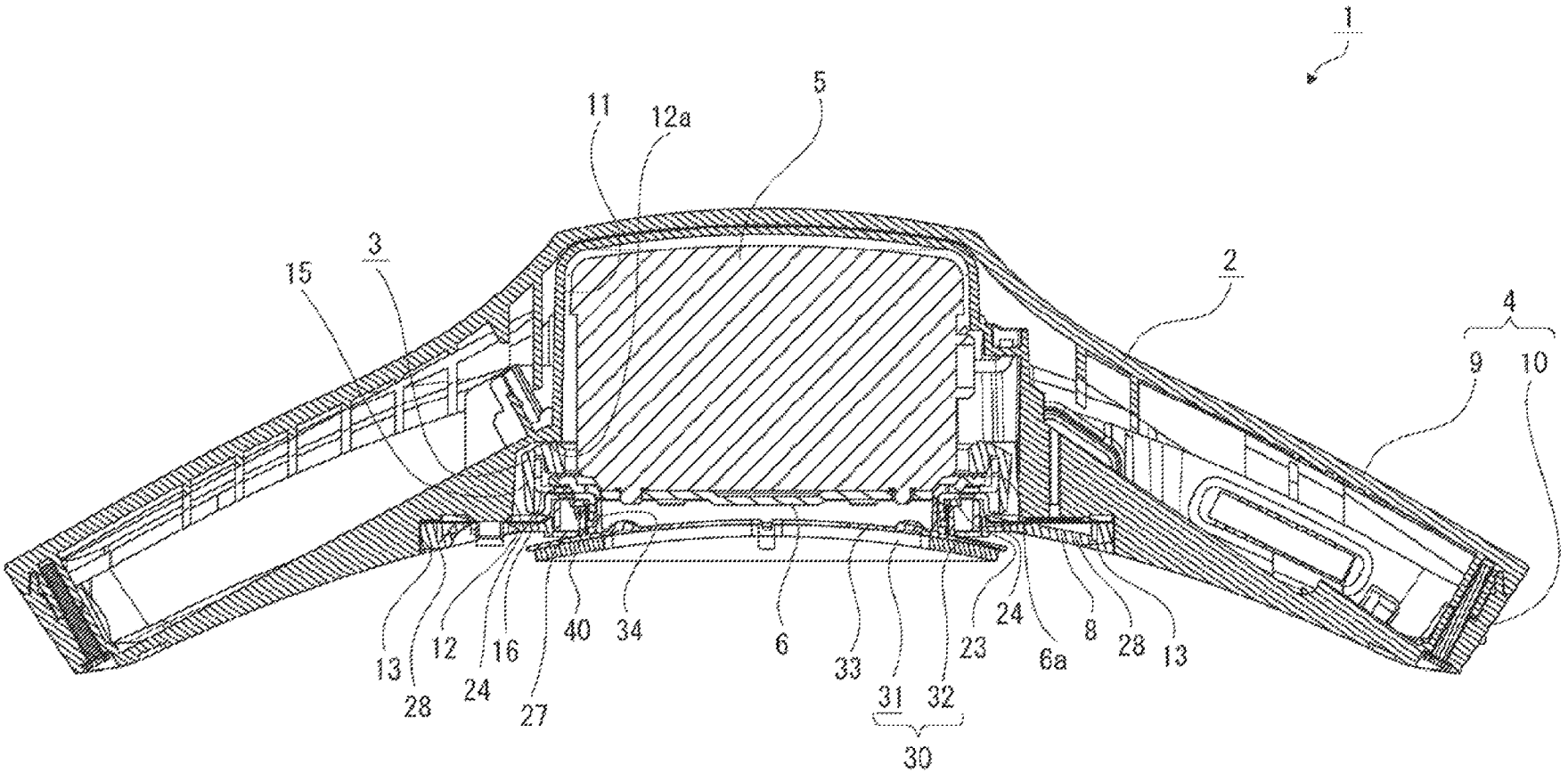
FIG. 4 is a cross-sectional view illustrating the loudspeaker device attached to the adapter.

The actuator 5 is arranged by insertion into the placement recess 11 (see FIG. 3 and FIG. 4). The actuator 5 is provided with an unillustrated magnet, coil, yoke and so forth, all these components making up a magnetic circuit. The actuator 5 is connected via a connecting wire to the circuit board.

Figure 6:
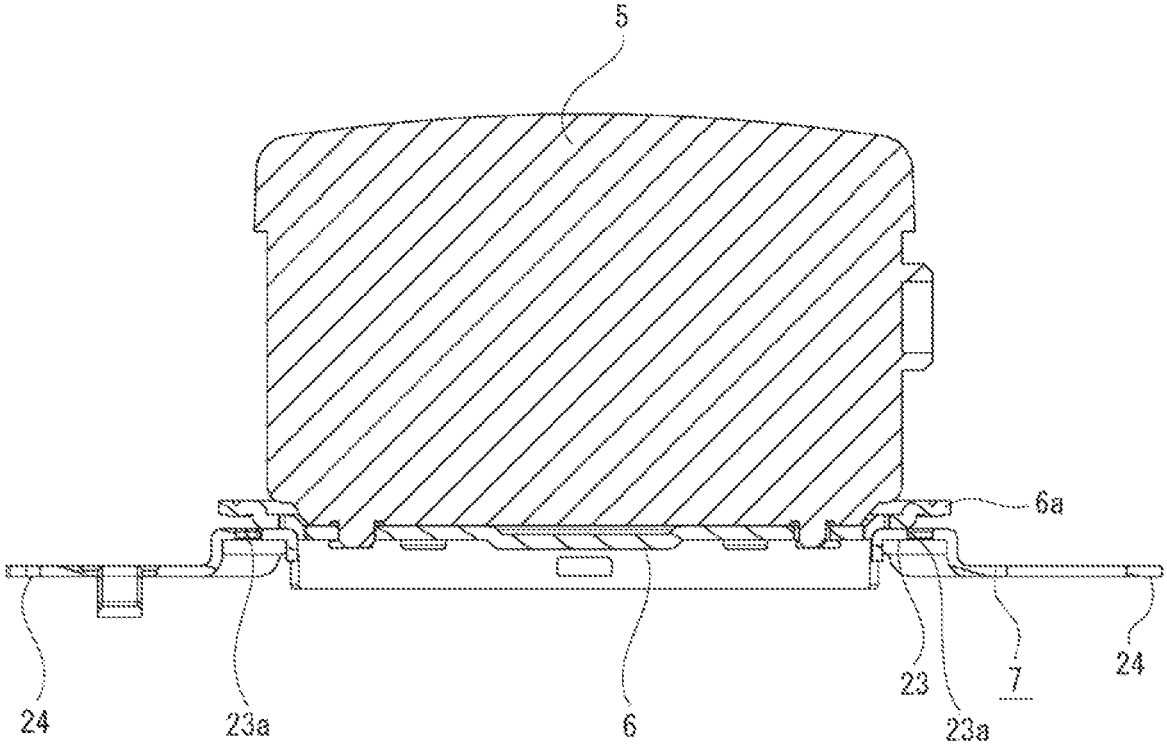
FIG. 6 is an enlarged cross-sectional view illustrating the actuator, a mounting plate, and a base member.

On the mounting plate 6, the actuator 5 is mounted (see FIG. 6). The mounting plate 6 is formed in a nearly discotic shape, and on a portion excluding the outer rim, mounted is the bottom face of the actuator 5. The outer rim of the mounting plate 6 is provided as a catch part 6*a*.

Figure 2:
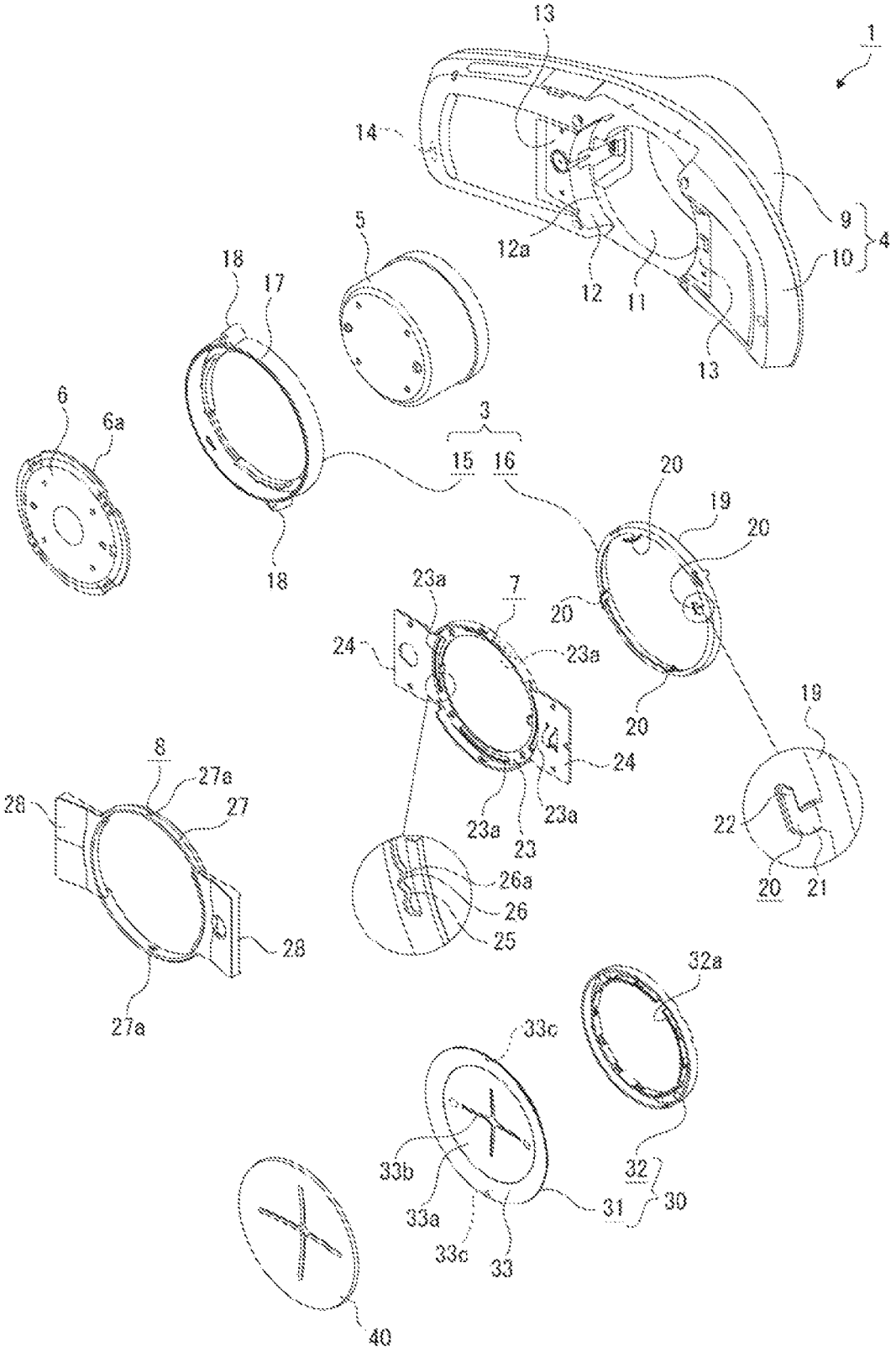
FIG. 2 is an exploded perspective view illustrating the loudspeaker device and the adapter.
Figure 7:
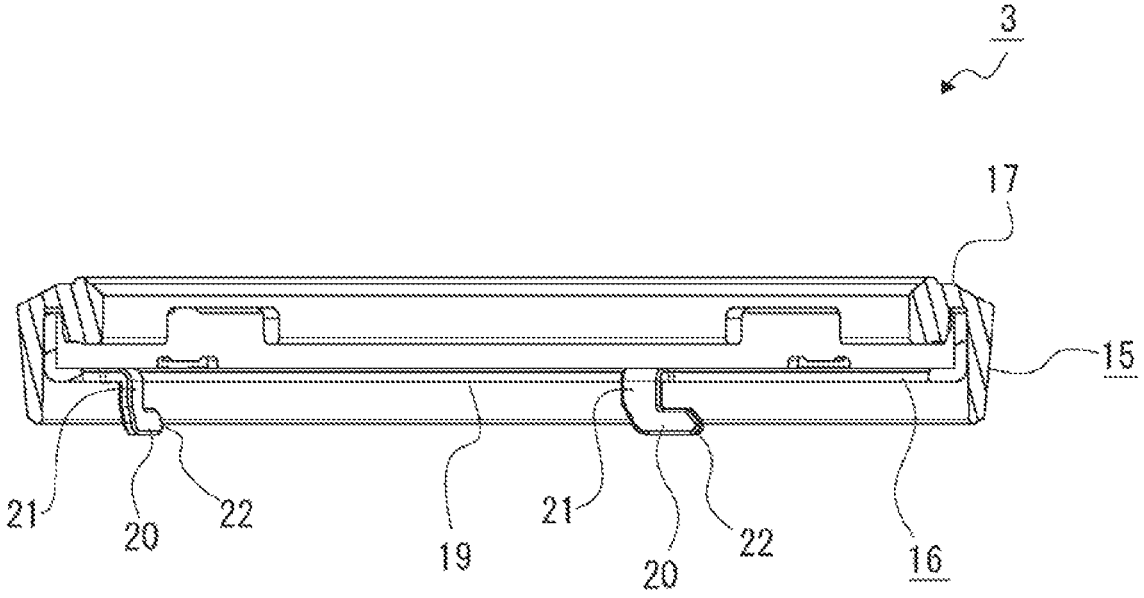
FIG. 7 is an enlarged cross-sectional view illustrating the lock lever.

The lock lever 3 is rotatably supported by the body 2 (see FIG. 3 and FIG. 4), and has an operation ring 15 and a working ring 16 coupled to each other (see FIG. 2 and FIG. 7).

The operation ring 15 has a nearly annular ring-shaped part 17 and operating projections 18, 18 that individually protrude outward from the outer circumferential face of the ring-shaped part 17. The operating projections 18, 18 are oppositely positioned 180 degrees to each other in the circumferential direction.

The working ring 16 has a nearly annular coupling part 19 and working projections 20, 20, . . . protruded downwards from the coupling part 19.

The coupling part 19 is formed with a diameter slightly shrunk from the ring-shaped part 17 of the operation ring 15, and is coupled with the operation ring 15 on the inner circumferential side of the ring-shaped part 17.

There are, for example, four working projections 20, 20, . . . arranged at regular intervals in the circumference direction. Each working projection 20 has a connective part 21 protruded downwards from the coupling part 19, and a locking part 22 protruded from the connective part 21 nearly in the circumferential direction.

The lock lever 3 has the operation ring 15, a part of the operation ring 15 being positioned between the catch surface 12*a* of the case 10 and the top face of the catch part 6*a* of the mounting plate 6 (see FIG. 3 and FIG. 4). The lock lever 3 can therefore be rotated relative to the body 2, while being suppressed from vertically shifting by the catch surface 12*a* and the catch part 6*a*. The lock lever 3 can be rotated easily by pressurizing one of the operating projections 18, 18 through a finger. The lock lever 3 has the working projection 20, 20, . . . positioned on the bottom face side of the catch part 6*a*.

The base member 7 has an attachment part 23 formed in a nearly annular shape, and mountable parts 24, 24 formed in the shape of nearly rectangular plate that are protruded leftwards and rightwards from the attachment part 23 (see FIG. 2 and FIG. 6). On the outer circumferential part of the attachment part 23, arranged are, for example, four through-holes 23*a*, 23*a*, . . . arranged at regular intervals in the circumference direction. Each through-hole 23*a* is formed in the shape of arc.

The attachment part 23 has, for example, two through-holes 23*a*, 23*a* that are oppositely positioned 180 degrees to each other, in which the opening edges of the through-holes 23*a*, 23*a* are individually provided with first locking ridges 25, 25 and second locking ridge 26, 26 which are arranged in line. The first locking ridge 25 and the second locking ridge 26 are arranged in line in the circumferential direction, so as to protrude towards the center of the attachment part 23. The first locking ridge 25 and the second locking ridge 26 are positioned at one end, in the circumferential direction, of each through-hole 23*a*, in which the first locking ridge 25 is positioned more closer to the end, in the circumferential direction of the through-hole 23*a*, than the second locking ridge 26 is. A top 26*a* of the second locking ridge 26 is positioned slightly closer to the center of the attachment part 23, than the top of the first locking ridge 25 is.

To the attachment part 23, the mounting plate 6 is fixed typically by screwing or the like. The actuator 5 mounted on the mounting plate 6 is therefore fixed via the mounting plate 6 to the base member 7.

The base member 7 is attached to the case 10 in such a way that the attachment part 23 is inserted into the annular recess 12, and the mountable parts 24, 24 are individually placed in the mounting recesses 13, 13 (see FIG. 1, FIG. 3 and FIG. 4).

With the base member 7 attached to the case 10, the working projections 20, 20, . . . of the lock lever 3 are individually inserted into the through-holes 23*a*, 23*a*, . . . of the base member 7, and are allowed to protrude downwards from the base member 7.

The dressing cover 8 has an annular part 27 formed in a nearly annular shape, and fixable parts 28, 28 formed in the shape of nearly rectangular plate that are protruded leftwards and rightwards from the annular part 27 (see FIG. 1 to FIG. 4). On the outer circumferential face of the annular part 27, provided are outwardly protruding marks 27*a*, 27*a* which are oppositely positioned 180 degrees to each other in the circumferential direction.

The dressing cover 8 is fixed to the case 10 typically by screwing or the like, with the fixable parts 28, 28 individually inserted into the mounting recesses 13, 13. In this design, the mountable parts 24, 24 of the base member 7 are tightened together to the case 10, while being pressurized by the fixable parts 28, 28 from below. The actuator 5 mounted on the mounting plate 6 is therefore fixed via the mounting plate 6 and the base member 7 to the case 10.

<Structure of Adapter>

Figure 5:
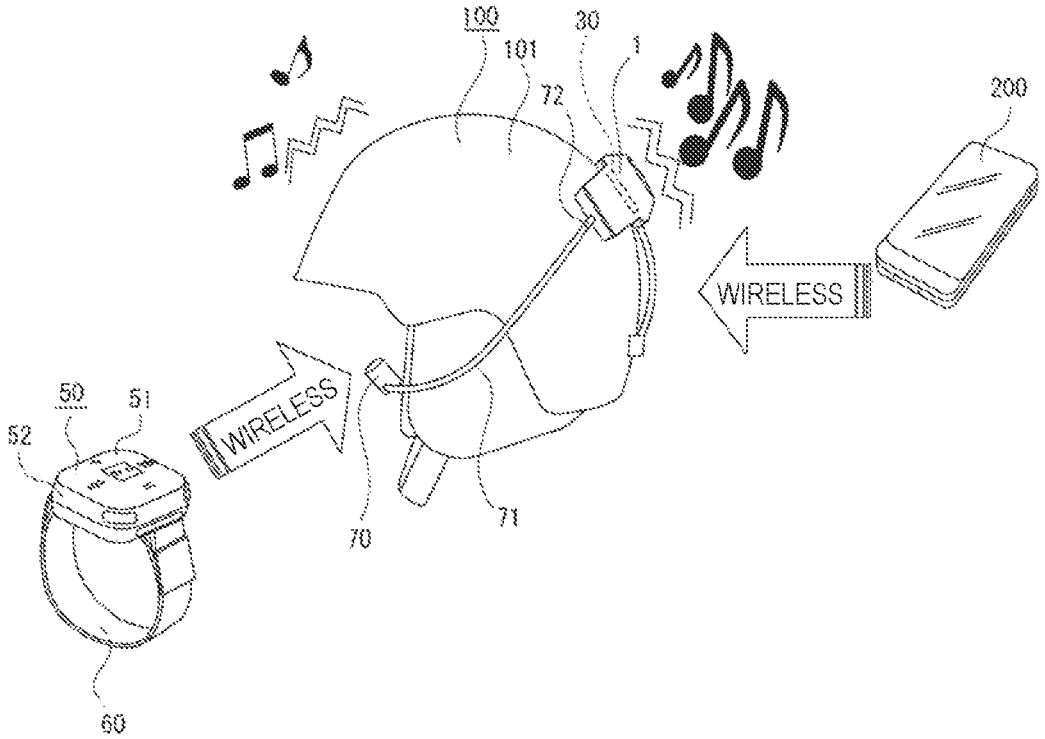
FIG. 5 is a schematic drawing illustrating an exemplary usage of the loudspeaker device.

The thus composed loudspeaker device 1 is mounted via the adapter 30 on the helmet 100 (see FIG. 5). The loudspeaker device 1 is designed to be attachable and detachable to and from the adapter 30.

Figure 8:
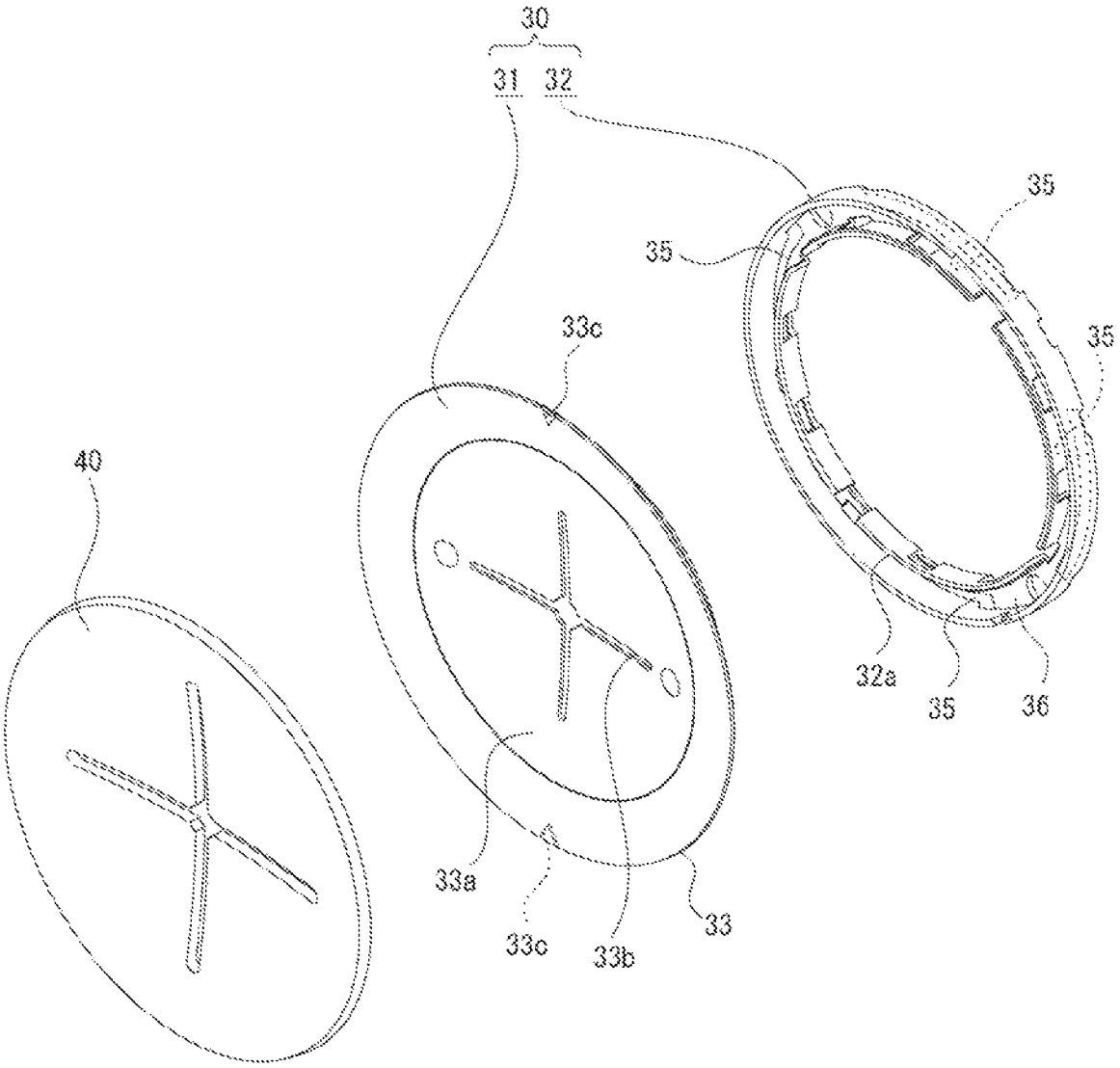
FIG. 8 is an enlarged exploded perspective view illustrating the adapter and a release paper.
Figure 9:
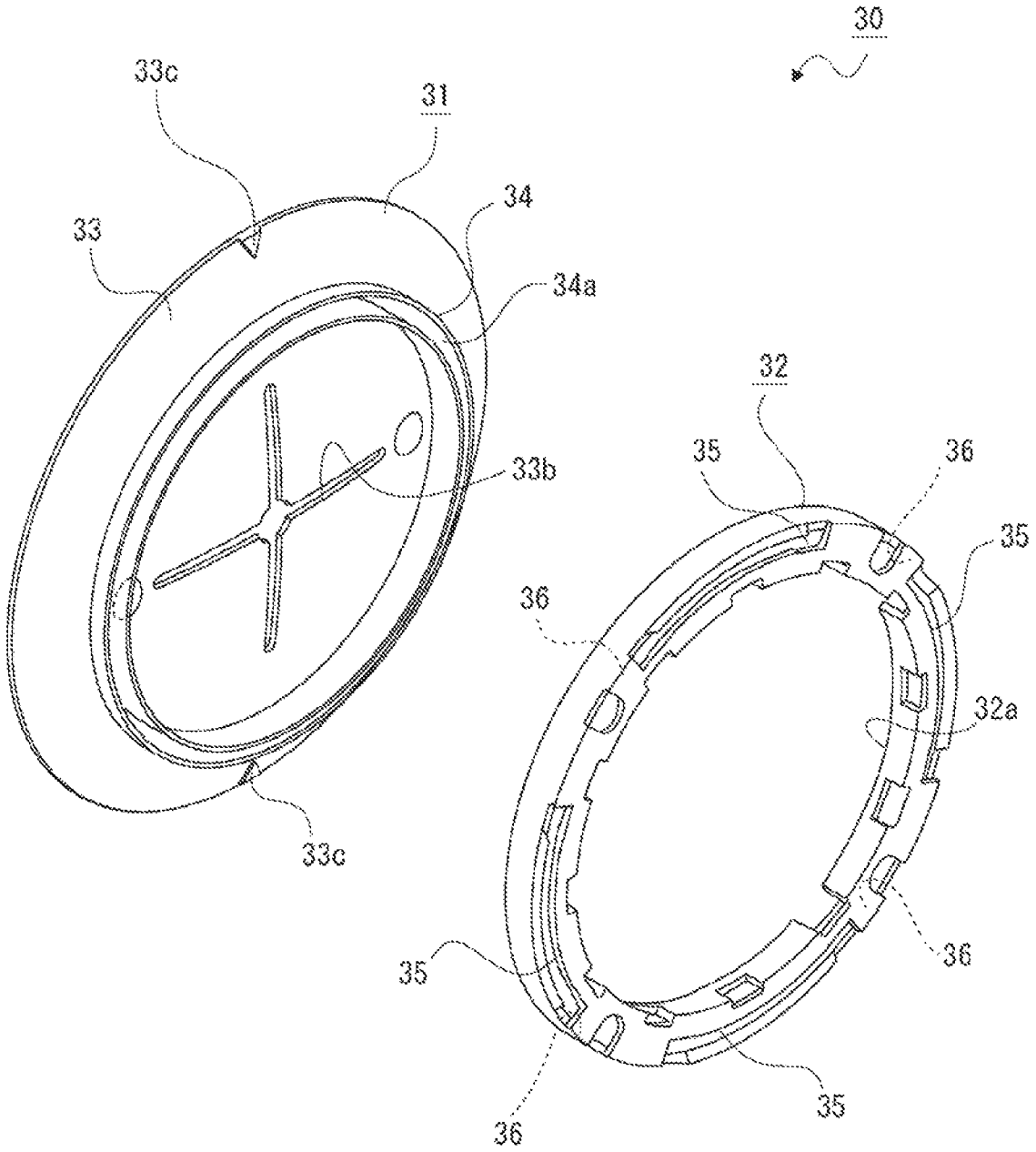
FIG. 9 is an enlarged exploded perspective view illustrating the adapter.
Figure 10:
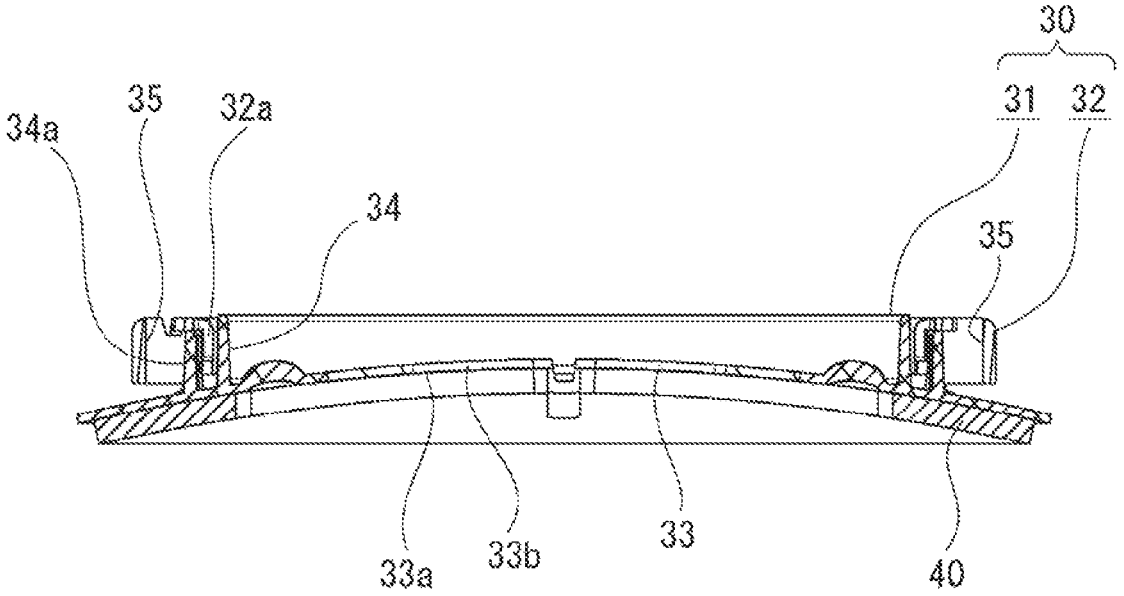
FIG. 10 is an enlarged cross-sectional view illustrating the adapter.

The adapter 30 has a mounting base 31 and a locking base 32 (see FIG. 8 to FIG. 10).

The mounting base 31 has a joint part 33 with a gentle spherical surface that swells downwards, and a coupling ridge 34 that rises upwards from the top face of the joint part 33. The lower face of the joint part 33 is coated with an unillustrated adhesive, so that the lower face of the joint part 33 is formed to serve as a joint surface 33*a*.

The joint part 33 has a circular external form, and includes a flexible material. The joint part 33 has a cruciform slit 33*b*, in which the center of cross of the slit 33*b* coincides with the center of the joint part 33. On the outer rim of the joint part 33, provided are protruded notch marks 33*c*, 33*c* that are oppositely positioned 180 degrees to each other in the circumferential direction.

The coupling ridge 34 rises up from a position close to the outer rim of the joint part 33, and has an annular coupling trench 34*a* that extends in the circumferential direction.

The locking base 32 is formed in a nearly annular shape, and has an insertion coupling part 32*a* along the inner circumference. The locking base 32 has insertion holes 35, 35, . . . formed at regular intervals in the circumferential direction. The insertion holes 35, 35, . . . are formed in the shape of arc that extends in the circumferential direction, and portions of the lower face of the locking base 32 between the insertion holes 35, 35, . . . are individually provided to serve as engagement parts 36, 36, . . . .

The locking base 32 is coupled with the mounting base 31, by inserting the insertion coupling part 32*a* into the coupling trench 34*a* for engagement. The lock lever 3 is built up by coupling the mounting base 31 and the locking base 32, and thereby the mounting base 31 and the locking base 32 can rotate integrally relative to the body 2.

The mounting base 31 has a release paper 40 placed on the joint surface 33*a*. After releasing the release paper 40 from the joint surface 33*a*, the adapter 30 can be mounted on the helmet 100.

<Structure of Remote Control Device>

Next, a remote control device 50 that allows the loudspeaker device 1 to operate will be explained (see FIG. 5 and FIG. 11).

For example, the remote control device 50 is typically formed in a nearly rectangular flat shape, and has major operation parts on a top face 51 and a circumferential face 52. When an operation is made on the remote control device 50, for example, a drive signal is wirelessly input to the loudspeaker device 1, the actuator 5 is allowed to operate in response to the input drive signal, and thereby various functions are executed.

For example, the loudspeaker device 1 also allows for input of signals from a mobile terminal 200 such as mobile phone, typically through wireless communication. For example, upon arrival of an incoming call in the mobile terminal 200, an incoming call signal is input to the loudspeaker device 1, making it possible for the user to talk by telephone with a caller, via the loudspeaker device 1 and using the microphone 70 or the like.

Figure 11:
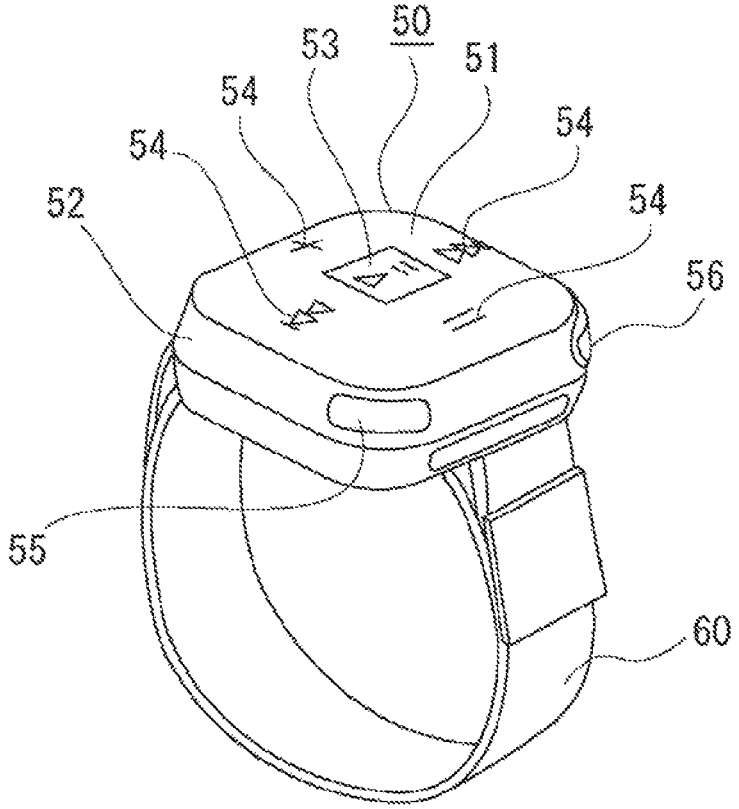
FIG. 11 is a perspective view illustrating a remote control device and a belt.

The top face 51 has a central operation part 53 provided at the center (see FIG. 11). Operations made on the central operation part 53 can effect music playback, pausing of music playback, stop of music playback, and the like on the loudspeaker device 1. Operations made on the central operation part 53 can also effect start of talk upon arrival of an incoming call in the mobile terminal 200, and stop of talk.

Note that, in the case where an incoming call arrives during music playback, the incoming call function will be given priority to enable talk.

In the circumferential area around the central operation part 53 on the top face 51, peripheral operation parts 54, 54, . . . are provided. Operations made on the peripheral operation parts 54, 54, . . . can effect fast forwarding, rewinding and volume control during music playback on the loudspeaker device 1.

The circumferential face 52 has a first operation part 55 and a second operation part 56 provided at the respective corners.

The loudspeaker device 1 allows for talk among respective users (group talk) when used individually by a plurality of users, in which operations made on the first operation part 55 can preset grouping according to which group talk is enabled through the microphone 70 or the like. In addition, with the grouping being preset, operations made on the first operation part 55 can start or terminate the group talk.

In the case where an incoming call arrives during the group talk, the incoming call function will be given priority to enable talk. In addition, the group talk is given priority over music playback, so that the loudspeaker device 1 is preset to process incoming call, group talk and music playback, in this order of precedence.

Operations made on the second operation part 56 can instantly turn down the volume of playback sound, and can instantly turn up (return) the lowered playback sound.

Operations made on the second operation part 56 can also change frequency characteristics of the playback sound (music).

The remote control device 50 has an unillustrated belt coupling part provided on the lower face, making it possible to couple a belt 60 with the belt coupling part. By coupling the belt 60 with the remote control device 50, it now becomes possible to use the remote control device 50 with the belt 60 worn around the arm, and to make the remote control device 50 usable more conveniently.

<Mounting, Etc. of Loudspeaker Device on Helmet>

The loudspeaker device 1 is made attachable and detachable to and from the adapter 30 as described above, and is mounted via the adapter 30 on the helmet 100. Procedures for mounting and unmounting the loudspeaker device 1, or the like will be explained below (see FIG. 12 to FIG. 15).

Figure 12:
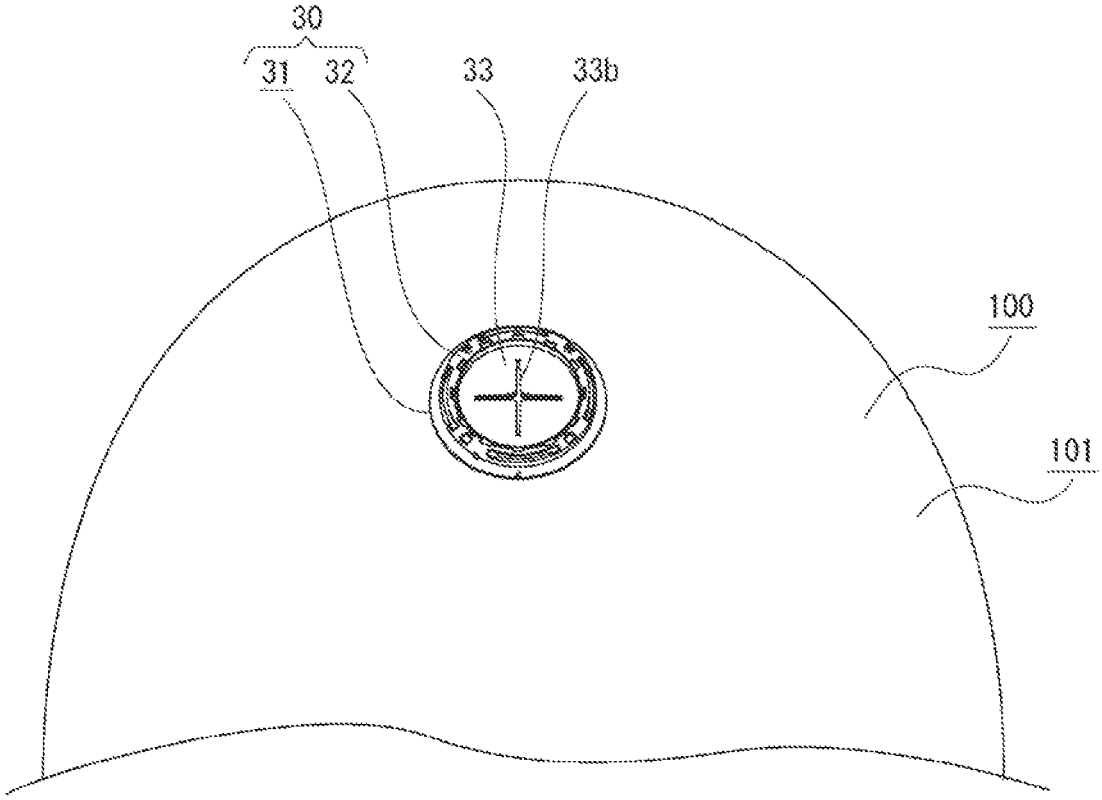
FIG. 12 illustrates, in conjunction with FIG. 13 to FIG. 15, operation relevant to mounting of the loudspeaker device, and is a rear view illustrating the helmet joined with the adapter.

First, the release paper 40 is released from the joint surface 33*a* of the adapter 30, and the joint surface 33*a* is pressurized against a desired mounting position on the outer face 101 of the helmet 100 (see FIG. 12).

Next, the entire portion of the joint part 33 is pressurized from the top with a jig or fingers. With the joint surface 33*a* pressurized against the mounting position, the radius of curvature of the joint surface 33*a* may occasionally be different from the radius of curvature of the outer face 101 depending on the geometry of the outer face 101. The joint part 33, however, has formed therein a cruciform slit 33*b*, so that the joint part 33 can be bent when pressurized from the top with a jig or fingers. The bent joint part 33 can therefore deform along the outer face 101, making it possible to bring the entire portion of the joint surface 33*a* into contact with the outer face 101, and to make the adapter 30 highly adhesive to the helmet 100.

Next, the loudspeaker device 1 will be attached to the adapter 30 as follows.

First, with the lock lever 3 rotated up to one end of rotation, the marks 27*a*, 27*a* provided to the annular part 27 of the dressing cover 8 are individually aligned to the notch marks 33*c*, 33*c* provided to the joint part 33 of the adapter 30, and the attachment part 23 of the base member 7 is pressurized for mounting against the locking base 32 of the adapter 30.

Figure 13:
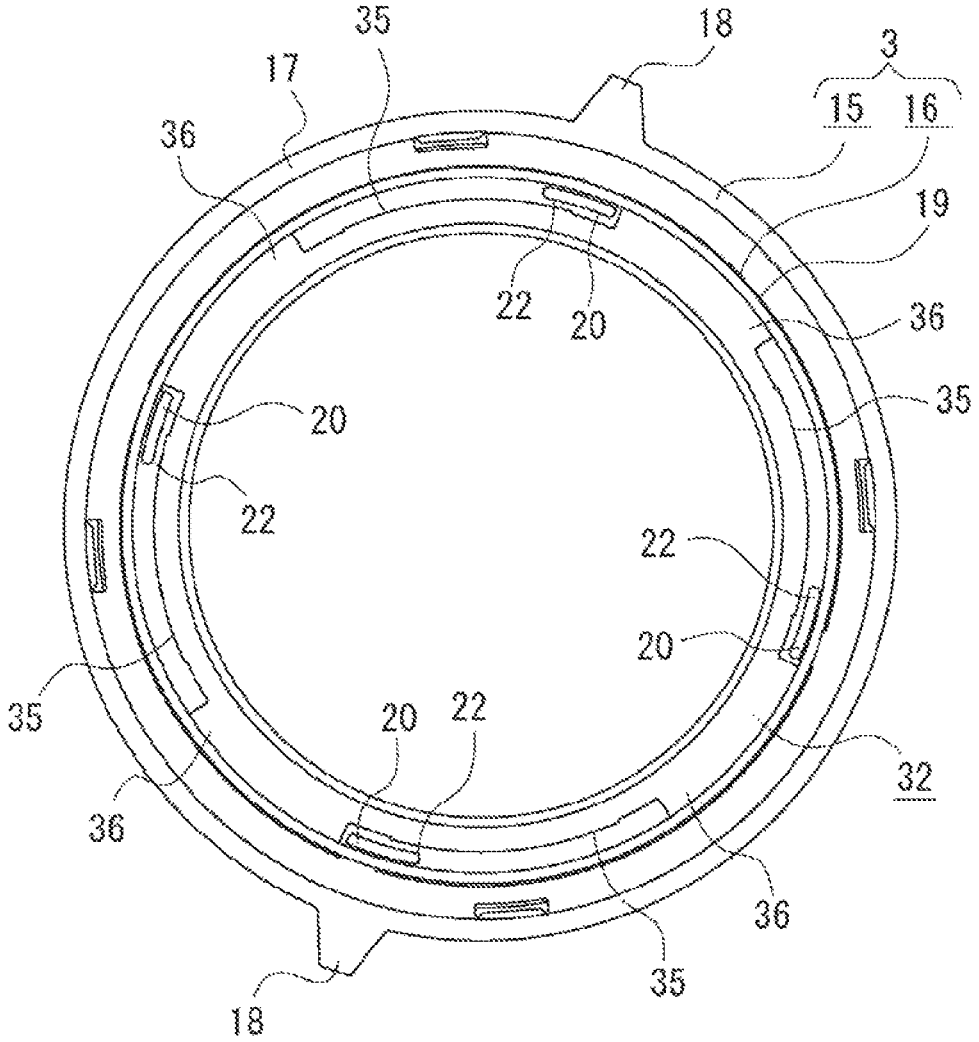
FIG. 13 is an enlarged bottom view illustrating a state before the body is locked.
Figure 14:
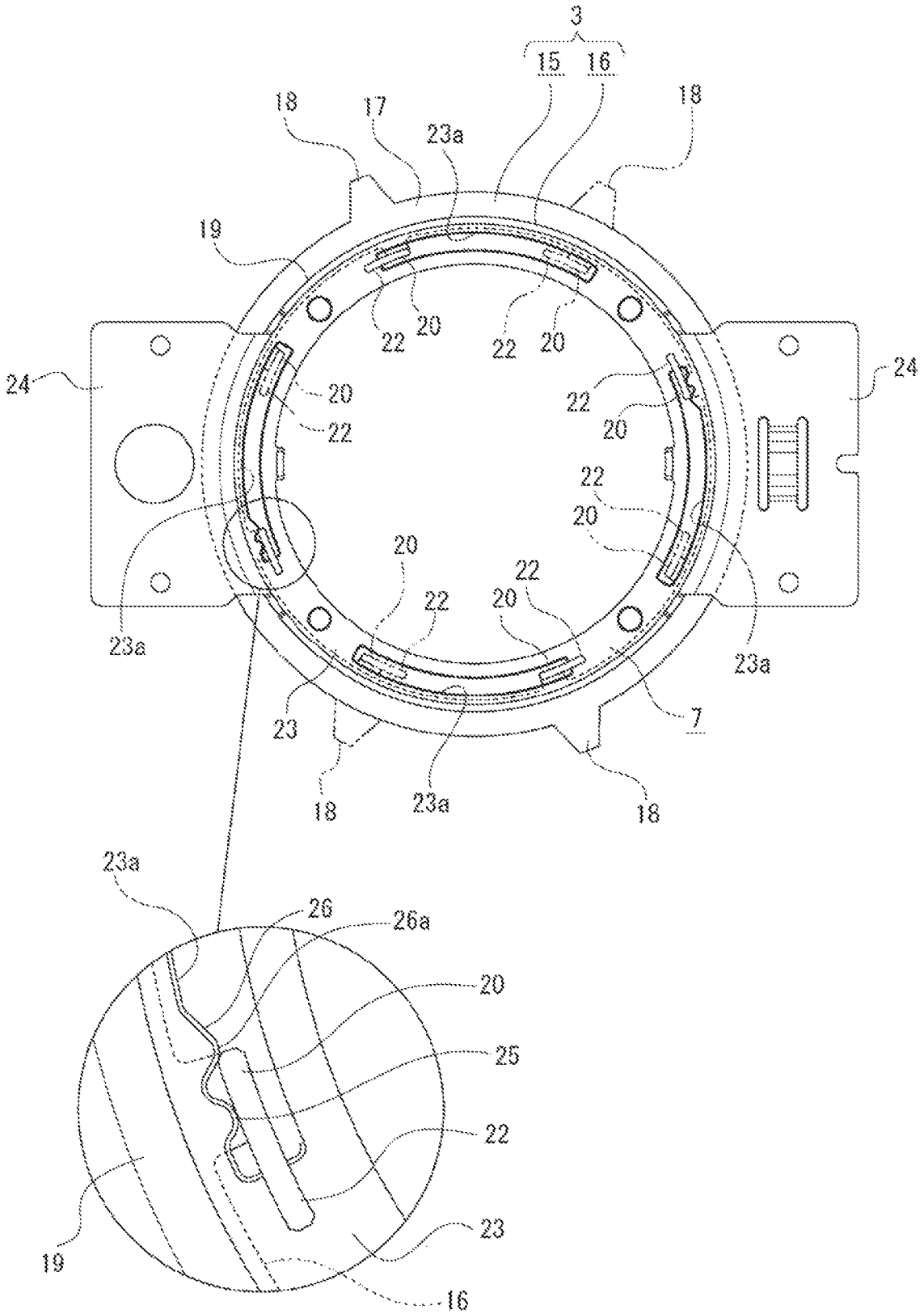
FIG. 14 is an enlarged bottom view illustrating a relation between the locking part and the locking ridge.
Figure 15:
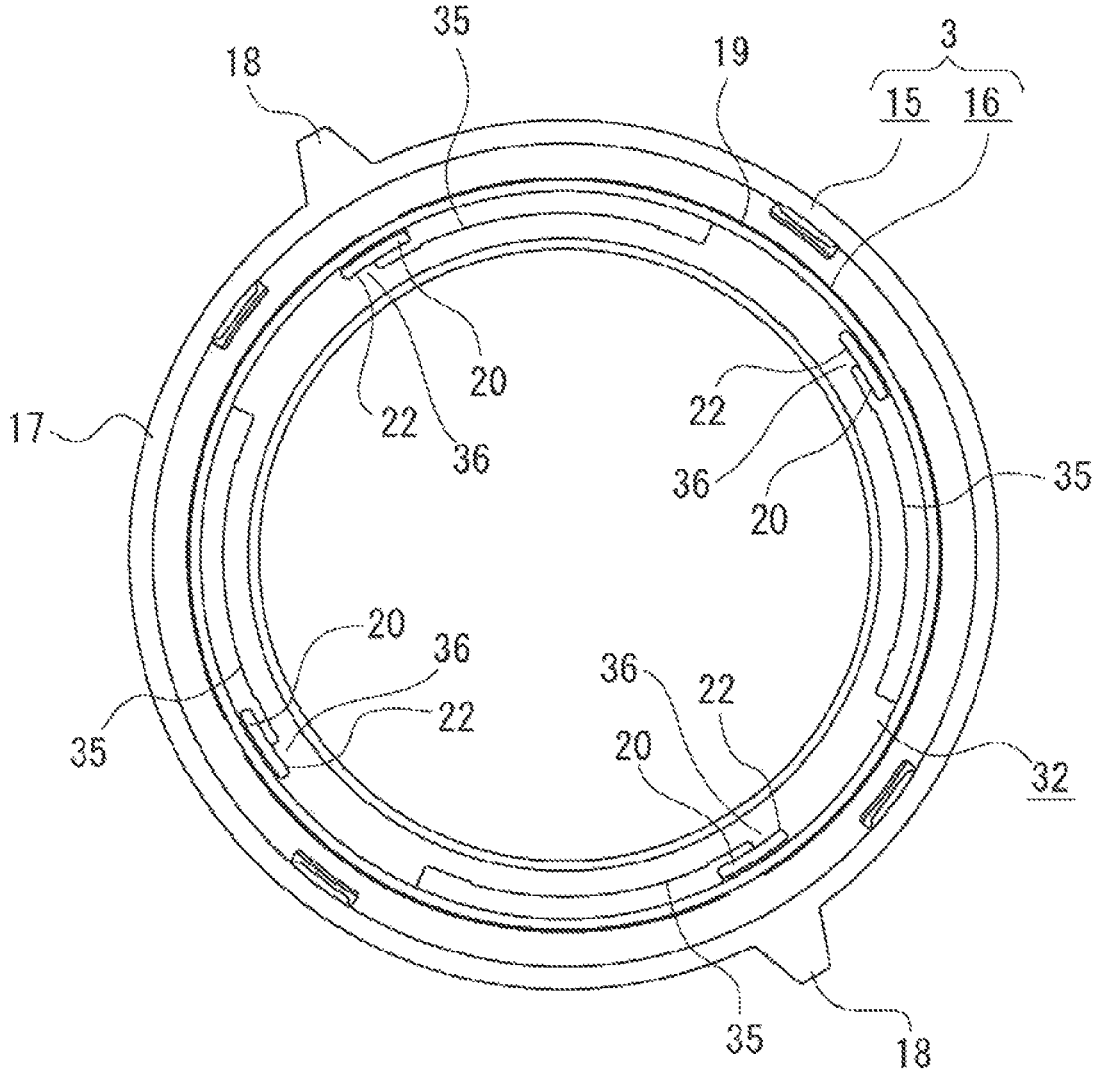
FIG. 15 is an enlarged bottom view illustrating a state after the body is locked.

With the attachment part 23 pressurized against the locking base 32 and mounted on the locking base 32, the lock lever 3 is positioned at one end of rotation as described above, and the working projections 20, 20, . . . of the lock lever 3 are individually inserted into the insertion holes 35, 35, . . . of the adapter 30 (see two-dot chain lines in FIG. 13 and FIG. 14).

Next, the lock lever 3 is rotated. With the lock lever 3 rotated, the working projections 20, 20, . . . , being kept inserted into the insertion holes 35, 35, are allowed to shift in the circumferential direction, thereby the locking parts 22, 22, . . . are individually engaged with the engagement parts 36, 36, . . . of the adapter 30, and the lock lever 3 is rotated up to the other end of rotation (refer to solid lines in FIG. 14 and FIG. 15). With the locking parts 22, 22, . . . individually engaged with the engagement parts 36, 36, . . . , the body 2 is locked on the adapter 30.

At the time immediately before the lock lever 3 is rotated up to the other end, side faces of two locking parts 22, 22 are individually allowed to slide sequentially along the second locking ridges 26, 26 and the first locking ridges 25, 25 provided to the attachment part 23, and the working projections 20, 20 are elastically deformed so as to be slightly shifted towards the center of the lock lever 3. When the lock lever 3 is rotated thereafter up to the other end of rotation, the two locking parts 22, 22 are elastically returned after individually crossing over the tops 26*a*, 26*a* of the second locking ridges 26, 26, and the edges of the locking parts 22, 22 are individually locked on the second locking ridges 26, 26.

When the locking parts 22, 22, . . . are individually engaged with the engagement parts 36, 36, . . . in this way, the elastically returned locking parts 22, 22 are individually locked on the second locking ridges 26, 26. Hence, when the body 2 is locked on the adapter 30, the hand used for locking can sense a touch of so-called clicking, caused when the elastically returned locking parts 22, 22 are locked at the edges on the second locking ridges 26, 26, making it possible for the user to easily recognize the state of locking, and to surely lock the body 2 on the adapter 30.

With the body 2 thus locked on the adapter 30, mounting of the loudspeaker device 1 onto the helmet 100 completes.

The loudspeaker device 1 thus mounted via the adapter 30 on the helmet 100 can be unmounted by rotating the lock lever 3 back to the one end of rotation. When the lock lever 3 is rotated back to the one end of rotation, the locking parts 22, 22, . . . are disengaged from the engagement parts 36, 36, . . . , and thereby locking of the body 2 on the adapter 30 is released.

With the lock lever 3 rotated back to the one end of rotation, the loudspeaker device 1 can be unmounted from the helmet 100 by pulling the loudspeaker device 1 frontwards away from the adapter 30.

The loudspeaker device 1 is thus mountable via the adapter 30 on the helmet 100, in which the loudspeaker device 1 has four locking parts 22, 22, . . . provided on the lock lever 3 at regular intervals in the circumferential direction, meanwhile the adapter 30 has four insertion holes 35, 35, . . . into which the locking parts 22, 22, . . . are individually inserted.

Figure 16:
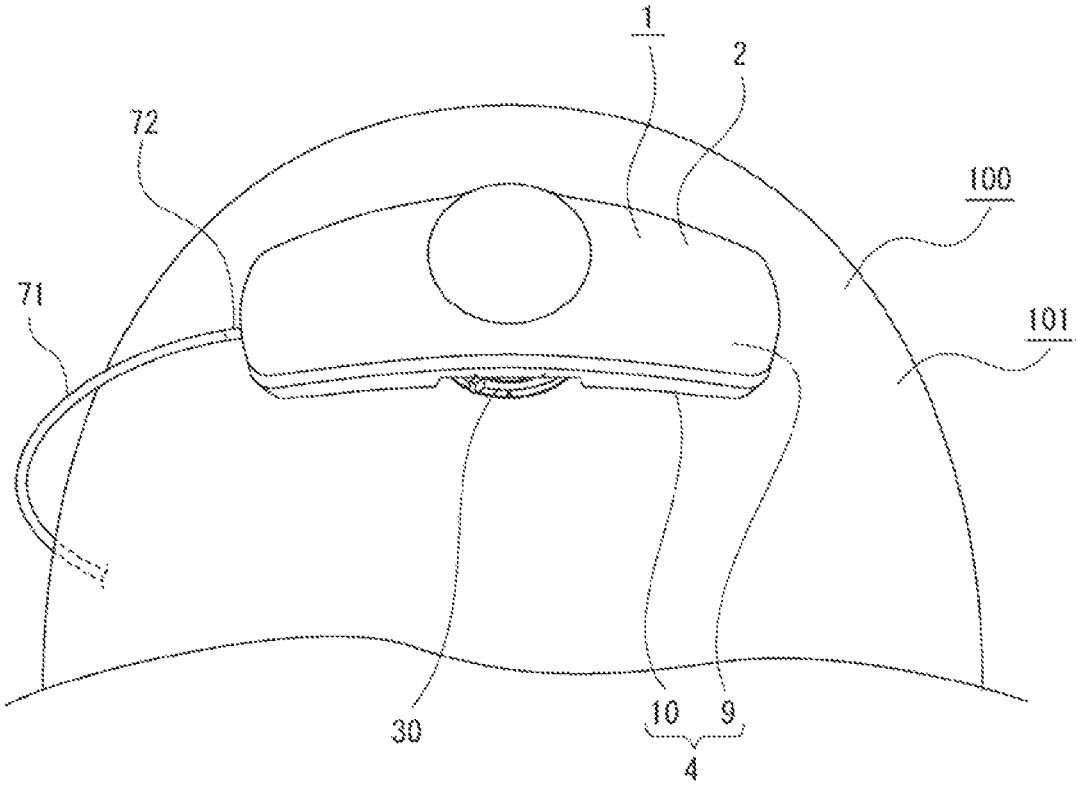
FIG. 16 is a rear view illustrating exemplary mounting of the loudspeaker device on the helmet, with the longitudinal direction aligned laterally.
Figure 17:
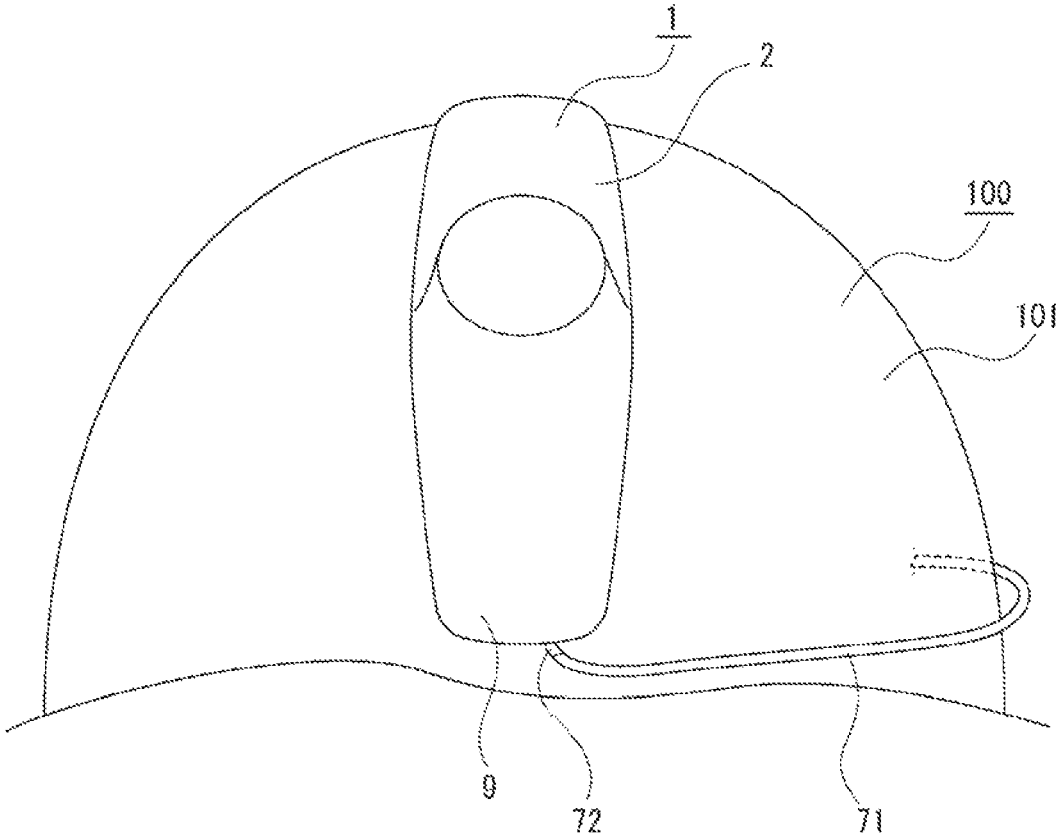
FIG. 17 is a rear view illustrating exemplary mounting of the loudspeaker device on the helmet, with the longitudinal direction aligned vertically.

The loudspeaker device 1 can therefore be mountable on the helmet 100, with a directionality variable by 90 degrees in the circumferential direction relative to the adapter 30. For example, the body 2 is mountable with the longitudinal direction aligned to the lateral direction (see FIG. 16), or the body 2 is mountable with the longitudinal direction aligned to the front-back direction or the vertical direction (see FIG. 17).

While being made variable regarding directionality of mounting relative to the adapter 30, the direction of the body 2 relative to the adapter 30 is made variable, and thereby the direction of the body 2 can be set depending on the situation, making it possible to improve the ease of use.

In particular, directional change of the body 2 enables positional change of the connection jack 14 relative to the helmet 100, making it possible to use the microphone 70 while routing the cable 71 around the head from a position of free choice. This improves the ease of use of the loudspeaker device 1 during phone talking.

<Operation in Loudspeaker Device>

When the helmet 100 with the mounted loudspeaker device 1 is worn on the user's head, the actuator 5, upon input of a drive signal, is allowed to operate (vibrate) in response to the input drive signal, and outputs sound according to the operation. The output sound is transmitted from the actuator 5 sequentially to the mounting plate 6, the base member 7, the adapter 30 and the helmet 100, and transmitted to the user mainly through bone conduction.

CONCLUSION

As described above, the loudspeaker device 1 includes a body 2 having an actuator 5 that operates in response to an input drive signal, and an attachment part 23 that is attachable to an adapter 30 mounted on a helmet 100 and having an engagement part 36; and, a lock lever 3 having a locking part 22, being rotatably supported by the body 2, and being designed to allow, when rotated, the locking part 22 to be engaged with the engagement part 36, which is designed to be attachable and detachable to and from the adapter 30, and the body 2 is designed to be locked on the adapter 30, as a result of engagement of the locking part 22 with the engagement part 36.

With such design, since mounting via the adapter 30 on the helmet 100 is made available by engaging the locking part 22 with the engagement part 36 of the adapter 30 mounted on the helmet 100, and the body 2 is locked on the adapter 30, so that the loudspeaker device 1 allows for easy mounting on the helmet 100, while being prevented in a mounted state from falling from the helmet 100.

<Present Technology>

Additionally, the present technology may also be configured as below.

(1)

A loudspeaker device including:

a body including an actuator that operates in response to an input drive signal, and an attachment part that is attachable to an adapter mounted on a helmet and including an engagement part; and a lock lever including a locking part, the lock lever being rotatably supported by the body, and designed so as to allow, when rotated, the locking part to be engaged with the engagement part, in which the loudspeaker device is designed to be attachable and detachable to and from the adapter, and the body is locked on the adapter, as a result of engagement of the locking part with the engagement part.

(2)

The loudspeaker device according to (1), including:

a housing having the actuator arranged inside; and a base member including a locking ridge against which the locking part, while being elastically deformed, is slid as the lock lever is rotated, the base member being fixed to the housing, in which, when the locking part is engaged with the engagement part, the locking part is locked at an edge on the locking ridge, after elastically returned as the locking part crosses over a top of the locking ridge.

(3)

The loudspeaker device according to (1) or (2), in which directionality of mounting relative to the adapter is variable.

REFERENCE SIGNS LIST

1 loudspeaker device
2 body
3 lock lever
4 housing
5 actuator
7 base member
22 locking part
23 attachment part
26 second locking ridge
26*a* top
30 adapter
36 engagement part
100 helmet

The invention claimed is:

1. A loudspeaker device, comprising:

a body including:

an actuator configured to operate based on an input drive signal;

a housing, wherein the actuator is inside the housing; and a base member fixed to the housing, wherein the base member includes an attachment part, the attachment part is attachable to an adapter mounted on a helmet, the adapter includes an engagement part, and the attachment part includes a locking ridge; and a lock lever including a locking part, wherein the lock lever is rotatably supported by the body, the lock lever is configured to allow, when rotated, the locking part to be engaged with the engagement part, the locking part is configured to slid against the locking ridge, while being elastically deformed, based on a rotation of the lock lever, and based on engagement of locking part with the engagement part, the locking part is further configured to:

elastically return after the locking part crosses over a top of the locking ridge; and to be locked at an edge on the locking ridge, wherein the loudspeaker device is attachable to and detachable from the adapter, and the body is configured to be locked on the adapter based on an engagement of the locking part with the engagement part.

2. The loudspeaker device according to claim 1, wherein directionality of mounting of the loudspeaker device relative to the adapter is variable.

3. The loudspeaker device according to claim 1, wherein an outer circumferential part of the attachment part includes a plurality of through-holes at regular intervals in a circumference direction, and the locking ridge is in a circumferential direction of each of the plurality of through-holes.

4. The loudspeaker device according to claim 1, wherein the attachment part includes a mountable part that protrude from the attachment part.

5. The loudspeaker device according to claim 4, wherein the housing includes a case, wherein the case includes:

an annular recess at a lateral center of the case; and a mounting recess on an outer circumference of the annular recess, the base member is attached to the case, the attachment part is inserted into the annular recess, and the mountable part is inserted in the mounting recesses.

* * * * *